United States Patent [19]

Langer

[11] Patent Number: 4,703,695

[45] Date of Patent: Nov. 3, 1987

[54] APPARATUS FOR COMPENSATION OF LINEAR THERMAL EXPANSION

[75] Inventor: Stefan Langer, Ingolstadt, Fed. Rep. of Germany

[73] Assignee: Messerschmitt-Bölkow-Blohm GmbH, Fed. Rep. of Germany

[21] Appl. No.: 796,607

[22] Filed: Nov. 8, 1985

[30] Foreign Application Priority Data

Nov. 15, 1984 [DE] Fed. Rep. of Germany ..... 3441693

[51] Int. Cl.[4] ..... F42B 11/22

[52] U.S. Cl. ..... 102/476; 102/305; 403/29

[58] Field of Search ..... 102/305–310, 102/475, 476; 403/29, 30

[56] References Cited

U.S. PATENT DOCUMENTS 3,454,313 7/1969 Lohneis ..... 403/30

3,978,795 9/1976 Strunk et al. ..... 102/476

FOREIGN PATENT DOCUMENTS 2087503 5/1982 United Kingdom ..... 403/30

*Primary Examiner*—Harold J. Tudor

*Attorney, Agent, or Firm*—McGlew and Tuttle

[57] ABSTRACT

An apparatus to compensate for the thermal expansion of a component inserted between two elements, particularly an explosive member placed between a lining, and a cover plate in a shaped charge, comprises two rings that are in contact with one another through conical inner and outer surfaces. The ring with the conical outer surface is made of a material that has a lower coefficient of thermal expansion than the material of the ring with the conical inner surface. So that the apparatus expands upon reduction in temperature and contracts upon increase in temperature to compensate for respective contraction and expansion of the component.

3 Claims, 7 Drawing Figures

APPARATUS FOR COMPENSATION OF LINEAR THERMAL EXPANSION

FIELD AND BACKGROUND OF THE INVENTION

The present invention reletes in general to devices for thermal expansion compensation, and in particular to a new and useful apparatus which can compensate for linear thermal expansion between elements which are connected together and which may expand or contract with respect to each other.

Because of the fact that the coefficient of thermal expansion of an explosive (in the case of explosives associated with TNT the coefficient of thermal expansion $\alpha = 50$ to $60 \times 10^{-6}\,\mathrm{dgr}^{-1}$) is roughly double that of the shell material, which is usually metal and most commonly aluminum (coefficient of thermal expansion $\alpha = 23.8 \times 10^{-6}\,\mathrm{dgr}^{-1}$), under the influence of temperature, linear differences occur between the explosive member and the shell.

In other words, when there is a temperature increase, the explosive member expands more than the shell, with the result that the shell and cover plate deform and stress cracks may appear in the explosive member.

When temperature drops, on the other hand, the explosive member shrinks more than the shell. This can result in the base of the lining coming loose from its abutment, which may consist, for example, of a ring screwed into the shell or the inner flanged edge of the shell. The lining is then no longer adequately attached, and can be shaken loose from the explosive member by, e.g. environmental incluences, shock or vibration, for example.

It can also happen, however, that the liner becomes skewed inside the shell, so that when the explosive member shrinks, considerable stress is created between the lining and the explosive member that can lead to a gap between the lining and the explosive member or to cracks in the explosive member.

SUMMARY OF THE INVENTION

The present invention is intended to solve the problems caused in a device by thermal expansion. According to the invention, an apparatus is provided between two elements of a device to compensate for thermal expansion. The apparatus is capable, in particular, of compensating for the differential linear change in a shell and an explosive member of a shaped charge, upon fluctuations in temperature.

When the apparatus pursuant to the invention is employed in a shaped charge between the base of the lining and the abutment on which the lining rests, as the explosive member shrinks more than the shell, as temperatures drop, the lining is shifted by the apparatus in the direction of the explosive member, while the side of the rings facing the abutment or lining remains in firm contact with the abutment or the base of the lining. In other words, the apparatus pursuant to the invention achieves compensation of the explosive member and shell, tolerance compensation of the explosive member and shell and hence perfect attachment of the lining of the shaped charge within the shell even under mechanical environmental influences, both direct, such as shock and vibration, and indirect, such as the effects of temperature.

Accordingly an object of the present invention is to provide an apparatus for compensation of thermal expansion between two members in a linear direction comprising at least two rings having mutually contacting inner and outer conical surfaces positioned between the members, the ring having the outer conical surface being made of material which has a lower coefficient of thermal expansion than the material making up the ring having the inner conical surface whereby together the rings expand in the linear direction with reduction of temperature and contract in a linear direction with increase in temperature.

A further object of the present invention is to provide such an apparatus particularly for a shaped charge which has a shell containing an explosive member with a lining over the explosive member, the inventive apparatus being positioned between the lining and the shell for maintaining engagement between the lining and the explosive member even with a greater expansion and contraction in the linear direction of the explosive member with respect to the shell and the lining.

A still further object of the invention is to provide an apparatus for the compensation of thermal expansion which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
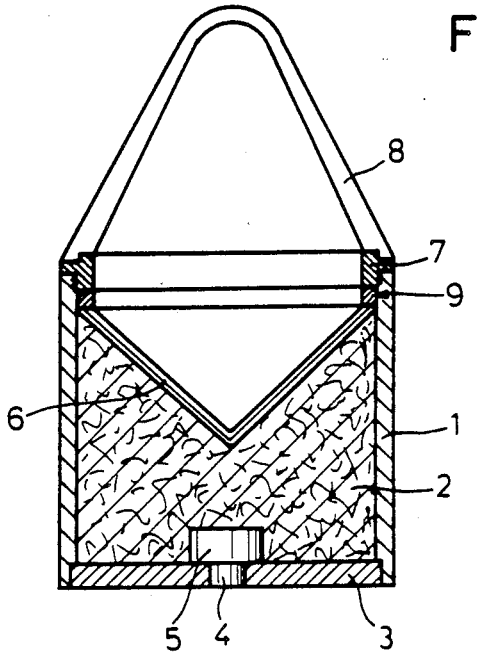
FIG. 1 is a longitudinal sectional view taken through a shaped charge equipped with the apparatus of the invention.

In FIG. 1 the shaped charge has a shell 1 holding the explosive member 2. Shell 1 is closed on the back end by a cover plate 3, which has a central hole where the primer charge 4 is located.

A booster charge 5 is fitted into a recess in the explosive member 2 opposite the primer charge 4.

At the front end of the explosive member 2 is a funnel-shaped lining 6. The abutment by means of which the lining 6 is secured in the shell 1 consists of a ring 7 that is screwed into the shell 1 and supports a dome 8 that completes the shell in front. Between the base of the funnel-shaped lining 6 and the screwed in ring 7 is positioned the apparatus or device 9 pursuant to the invention.

Figure 2A:
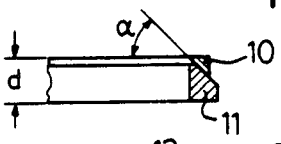
FIG. 2*a* is a sectional fragmentary enlarged view of a first embodiment of the invention shown during normal temperature conditions.
Figure 2B:
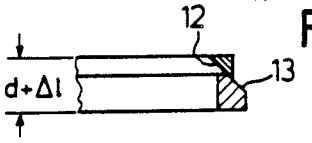
FIG. 2*b* is a view similar to FIG. 2*a* showing the inventive apparatus when the temperature falls.
Figure 2C:
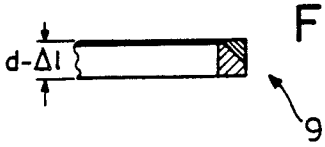
FIG. 2*c* is a view similar to FIG. 2*a* showing the inventive apparatus when the temperature rises.

In the embodiment shown in FIGS. 2*a* through 2*c*, the device 9 has two rings 10 and 11. Ring 10 has a conical inner surface 12 and ring 11 has a conical outer surface 13. The two conical surfaces 12 and 13 are in contact with one another.

The cone angle between the two surfaces 12 and 13 and the axis of rings 10 and 11 is designated as $\alpha$.

Ring 10 with conical inner surface 12 is made of a metal that has a relatively high coefficient of thermal expansion, e.g. aluminum or magnesium, whereas ring 11 is made of a metal that has a relatively low coefficient of thermal expansion, e.g. invar steel.

In FIG. 2*a* the position of the two rings 10 and 11 of the device 9 with respect to one another at normal or room temperatures is shown, while FIGS. 2*b* and 2*c* show the position of the two rings 10 and 11 at a relatively low temperature and a relatively high temperature, respectively.

As FIG. 2*b* shows, when the temperature falls below normal, ring 10 contracts sharply in comparison to ring 11, whereupon rings 10 and 11 slide against one another along their conical surfaces 12 and 13. By this means when the temperature drops, the width d of the device 9 consisting of the two rings 10 and 11 is enlarged ($d+\Delta 1$). On the other hand, when the temperature rises, devices 9 assumes the position shown in FIG. 2*c*, i.e. ring 10 expands more than ring 11 and this leads to a reduction in the width of the device 9 to ($d-\Delta 1$).

By appropriate selection of materials with respect to their coefficients of thermal expansion and the cone angle determining the extent of translation, the change $\Delta 1$ in the width d of the device 9 can be made to match perfectly the greater contraction or expansion of the explosive member 2 with respect to the linear change in the shell 1 upon a drop or rise in temperature.

Figure 3A:
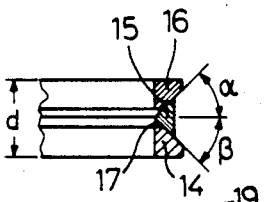
FIG. 3*a* is a sectional fragmentary enlarged view of a second embodiment of the invention shown at normal temperature.
Figure 3B:
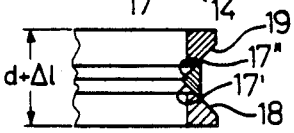
FIG. 3*b* is a view similar to FIG. 3*a* of the inventive apparatus shown at reduced temperature.
Figure 3C:
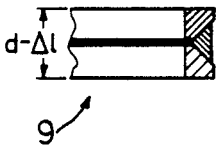
FIG. 3*c* is a view similar to FIG. 3*a* showing the inventive apparatus at increased temperature.

The embodiment shown in FIGS. 3*a* through 3*c* has three rings 14, 15 and 16. The inner surface 17 of the middle ring 15 is designed as a double cone. One conical surface 17' of the biconical inner surface 17 is in contact with the conical outer surface 18 of ring 14 and the other conical surface 17'' of the biconical inner surface 17 is in contact with the conical outer surface 19 of ring 16.

As in the embodiment shown in FIGS. 2*a* through 2*c*, in the embodiment shown in FIGS. 3*a* through 3*c* the ring 15 with the conical inner surface 17 is the one that is made out of a material with a greater coefficient of thermal expansion than the material of the rings 14 and 16 with the conical outer surfaces 18 and 19.

FIG. 3*a* shows the position of the three rings 14, 15 and 16 with respect to one another at normal temperatures, and FIGS. 3*b* and 3*c* show their positions at a relatively lower and higher temperature, respectively, whereby the width d of the device 9 consisting of the three rings 14, 15 and 16 is increased by $\Delta 1$ at lower temperatures (FIG. 2*b*) and reduced by $\Delta 1$ at higher temperatures (FIG. 2*c*) due to the relatively greater contraction or expansion of the middle ring 15 upon a drop or rise in temperature.

By appropriate selection of materials for the three rings 14, 15 and 16 with respect to their respective coefficients of thermal expansion and by means of the two angle $\alpha$ and $\beta$ of the two conical surfaces 17' and 17'', this embodiment offers a wide range of variation in the linear compensation to be achieved, i.e., a particularly precise match with the linear change in the explosive member 2 upon temperature fluctuations is possible.

Naturally, several of the devices shown in FIGS. 2*a* through 2*c* and 3*a* through 3*c* can also be positioned side by side.

While specific embodiments of the invention have been shown and described in detail to illustrate the application of the principles of the invention, it will be understood that the invention may be embodied otherwise without departing from such principles.

What is claimed is:

1. An apparatus for the compensation of thermal expansion in a linear direction comprising a shell having an abutment surface, an explosive member in said shell, a conical lining over said explosive member and having an abutment surface facing said abutment surface of said shell, at least two rings having mutually contacting and respective inner and outer conical surfaces, said at least two rings being positioned between abutment surfaces of said shell and said lining with said ring having said outer conical surface being made of material having a lower coefficient of thermal expansion than the material of said ring having said inner conical surface whereby increase in temperature and overall thickness of said at lest two rings in said linear direction decreases to compensate for thermal expansion of said shell and explosive member and, with reduction of temperature, the thickness of said at least two rings increases for compensating thermal contraction of the members, the angle between said conical surfaces and said linear direction being selected to maintain contact between said lining and said explosive member by achieving a selected expansion and contraction of the thickness of said rings with change in temperature, said rings always maintaining contact with each other and with said abutment surfaces.

2. An apparatus according to claim 1, wherein said ring having said first mentioned inner conical surface also has a second conical surface and comprises a middle ring, said apparatus including a third ring having a second outer conical surface in contact with said second inner conical surface of said middle ring, said third ring being made of material with a lower coefficient of thermal expansion than the material of said middle ring.

3. An apparatus according to claim 1, wherein said ring with said outer conical surface is made of steel, said ring with said inner conical surface being made of one of aluminum and magnesium.

* * * * *